US005462306A

United States Patent [19]

Barcaskey

[11] Patent Number: 5,462,306

[45] Date of Patent: Oct. 31, 1995

[54] GAS GENERATOR FOR VEHICLE OCCUPANT RESTRAINT

[75] Inventor: Eric S. Barcaskey, Phoenix, Ariz.

[73] Assignee: TRW Inc., Lyndhurst, Ohio

[21] Appl. No.: 392,605

[22] Filed: Feb. 22, 1995

Related U.S. Application Data

[63] Continuation-in-part of Ser. No. 6,817, Jan. 21, 1993, abandoned.

[51] Int. Cl.[6] ..... B60R 21/26; C06B 31/00

[52] U.S. Cl. ..... 280/736; 149/35; 280/741

[58] Field of Search ..... 149/35; 280/741, 280/736

[56] References Cited

U.S. PATENT DOCUMENTS

| | | | |
|---|---|---|---|
| Re. 32,584 | 1/1988 | Pietz | 149/35 |
| 3,122,462 | 2/1964 | Kaufman et al. | 149/35 |
| 3,741,585 | 6/1973 | Hendrickson et al. | 149/35 |
| 3,755,182 | 8/1973 | Marshall | 149/35 |
| 3,779,823 | 12/1973 | Price et al. | 149/35 |
| 3,785,674 | 1/1974 | Poole et al. | 149/35 |
| 3,865,660 | 2/1975 | Lundstrom | 149/35 |
| 3,895,098 | 7/1975 | Pietz | 149/35 |
| 3,931,040 | 1/1976 | Breazeale | 149/35 |
| 3,947,300 | 3/1976 | Passauer et al. | 149/35 |
| 3,996,079 | 12/1976 | DiValentin | 149/35 |
| 4,062,708 | 12/1977 | Goetz | 149/35 |
| 4,203,787 | 5/1980 | Kirchoff et al. | 149/35 |
| 4,243,443 | 1/1981 | Utracki | 149/35 |
| 4,376,002 | 3/1983 | Utracki | 149/35 |
| 4,758,287 | 7/1988 | Pietz | 149/35 |
| 4,834,817 | 5/1989 | Zeuner et al. | 149/35 |
| 5,064,483 | 11/1991 | Zeuner | 149/35 |

FOREING PATENT DOCUMENTS 9218443 10/92 EPO

OTHER PUBLICATIONS

Rmelins Handbuck, pages 273–276. Encyclopedia of Advanced Ceramic Materials.

*Primary Examiner*—Edward A. Miller
*Attorney, Agent, or Firm*—Tarolli, Sundheim & Covell

[57] ABSTRACT

The present invention resides in a vehicle occupant restraint assembly (12). The assembly comprises a vehicle occupant restraint (20), a housing (14), a gas generating composition (16) within the housing, an igniter (18) for igniting the gas generating composition, and gas flow means (22) for directing gas into the vehicle occupant restraint. In a preferred embodiment of the present invention, the vehicle occupant restraint (20) is an air bag. The gas generating composition (16) comprises lithium azide ($Li_3N$) and a metal oxidant (MeO), wherein O can be either oxygen or sulfur. The metal oxidant is present in a sub-stoichiometric amount relative to the lithium azide. The gas generating composition (16), on ignition, burns under reaction conditions which produce lithium nitride ($Li_3N$) and a combustion product which is essentially free of elemental lithium.

20 Claims, 1 Drawing Sheet

GAS GENERATOR FOR VEHICLE OCCUPANT RESTRAINT

This is a continuation-in-part of application Ser. No. 08/006,817, filed on Jan. 21, 1993, now abandoned.

BACKGROUND OF THE INVENTION

1. Technical Field

The present invention relates to a gas generator for a vehicle occupant restraint, such as an air bag, and to a gas generating composition which is used in the gas generator.

2. Description of the Prior Art

A large number of gas generating compositions have been proposed for generating gas to operate vehicle occupant restraints, such as air bags and pretensioners for seat belts. For air bags, in particular, compositions which produce an inert gas, such as nitrogen, have been preferred.

Excellent results have been achieved with a solid nitrogen generating composition which comprises an alkali metal azide fuel and a metal oxidant for the fuel. Compositions comprising these materials produce, on combustion, a nitrogen gas along with other products of reaction.

The solid nitrogen generating compositions are contained within a gas generator apparatus. The size and weight of the gas generator apparatus is dependent to a large extent on the amount of gas generating material. To generate enough gas to inflate an air bag, a substantial amount of nitrogen generating composition is required. The gas generator apparatus, particularly for a driver's side air bag, must be small and light weight, so as to be adapted to fit within the vehicle steering wheel. If the amount of nitrogen generating composition can be reduced without significantly affecting the performance of the gas generator apparatus, the size and weight of the gas generator apparatus can be reduced proportionately.

U.S. Pat. No. 3,741,585 discloses a gas generating composition for inflating a vehicle crash bag. The composition comprises a metal azide and an oxidizing agent. Lithium azide ($LiN_3$) is listed as one suitable metal azide. However, no reactions are disclosed which use this ingredient. The oxidizing agent can be a metal oxide, a metal sulfide or sulfur, a metal or organic iodide, or an organic chloride. Examples of metal oxides given in the patent are molybdenum trioxide, tungsten trioxide, lead dioxide, and vanadium pentoxide. The composition can contain 1–75 weight percent of an oxidizing agent. However, preferred compositions comprise 30 to 75 weight percent of a metal azide; e.g., 30 to 75 weight percent of sodium azide.

U.S. Pat. No. 3,895,098 discloses a gas generating composition for a vehicle occupant restraint system. The composition comprises an alkali metal azide and a metal oxide. The patent lists lithium azide as one suitable alkali metal azide. The patent calls for a slight excess of metal oxide to prevent, on combustion, the formation of alkali metal. The alkali metal, if formed, can burn spontaneously upon contact with air, and present a fire hazard. Also, an alkali metal residue can react with moisture to produce hydrogen, which is an undesirable by-product.

U.S. Pat. No. 3,931,040 also discloses the combustion of an alkali metal azide and a metal oxide to produce a nitrogen containing gas. A number of reactions involving different azides and different oxides are disclosed. One reaction equation disclosed in the patent uses lithium azide. The lithium azide is reacted with a stoichiometric amount of titanium dioxide. This reaction would be impractical for the reason advanced in the '098 patent. Specifically, without an excess of metal oxide, an alkali metal residue could form, presenting a fire hazard.

U.S. Pat. No. 4,758,287 is yet another patent that discloses the reaction of a alkali metal azide with a metal oxide. This patent is directed primarily to a method for preparing porous propellant grains. No reaction equation is disclosed in the patent involving the use of lithium azide. The patent discloses and claims the use of a stoichiometric excess of metal oxide to prevent the formation of alkali metals.

SUMMARY OF THE INVENTION

The present invention resides in a vehicle occupant restraint assembly. The assembly comprises a vehicle occupant restraint, a housing, a gas generating composition within the housing, an igniter for igniting the gas generating composition, and gas flow means for directing gas into the vehicle occupant restraint. In a preferred embodiment of the present invention, the vehicle occupant restraint is an air bag.

The gas generating composition comprises lithium azide ($LiN_3$) and a metal oxidant (MeO), wherein O can be either oxygen or sulfur. The metal oxidant is present in the gas generating composition in a sub-stoichiometric amount with regard to the lithium azide. The mol ratio of the lithium azide to the metal oxidant is that by which, on combustion of the gas generating composition, excess lithium in the combustion product reacts with nitrogen to form lithium nitride ($Li_3N$).

The vehicle occupant restraint assembly comprises a cooling surface to cool the combustion products. The amount of cooling surface preferably is an effective amount to cool the combustion products to a temperature below the melting point of the lithium nitride, preferably below about 850° C.

A preferred metal oxidant is iron oxide ($Fe_2O_3$). A preferred mol ratio of lithium azide to iron oxide in the gas generating composition of the present invention is more than about 7:1.

The present invention also resides in a gas generating composition for a vehicle occupant restraint comprising active components consisting essentially of lithium azide ($LiN_3$) and a metal oxidant (MeO), wherein O can be either oxygen or sulfur. The metal oxidant is present in the gas generating composition, with the lithium azide, in a sub-stoichiometric amount, the lithium azide and metal oxidant on combustion producing lithium nitride ($Li_3N$).

More preferably, the gas generating composition of the present invention comprises active components consisting essentially of lithium azide and a metal oxidant in a mol ratio effective to react according to the following equation:

$$zLiN_3 + Me_xO_y \rightarrow \frac{3z-1}{2} N_2 + yLi_2O + \frac{z-2y}{3} Li_3N + xMe$$

wherein O is either oxygen or sulfur.

Preferably, z equals approximately 3 plus 2y.

BRIEF DESCRIPTION OF THE DRAWINGS

Further features of the present invention will become apparent to those skilled in the art to which the present invention relates, from consideration of the following specification with reference to the accompanying drawings, in which.

DESCRIPTION OF A PREFERRED EMBODIMENT

Figure 1:
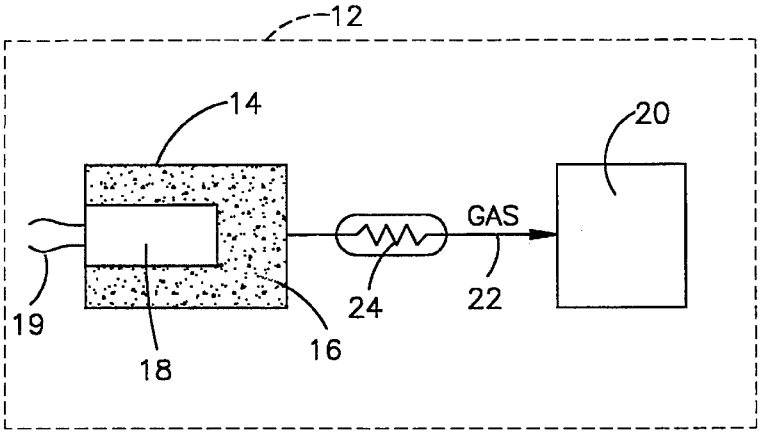
FIG. 1 is a schematic illustration of a vehicle occupant restraint assembly according to the present invention.

Referring to FIG. 1, the vehicle occupant restraint assembly 12 of the present invention comprises a housing 14. The housing 14 contains a gas generating composition 16. The gas generating composition 16 is ignited by an igniter 18 operatively associated with the gas generating composition 16. Electrical leads 19 convey current to the igniter 18 from an electric circuit that includes a power source and a sensor which is responsive to an event such as a vehicle collision. The assembly 12 also comprises a vehicle occupant restraint 20. A gas flow means 22 conveys gas, which is generated by combustion of the gas generating composition 16 within housing 14, to the vehicle occupant restraint 20. The gas flow means 22 comprises cooling surfaces 24, for example, a plurality of mesh screens, to cool the gas. In addition to mesh screens, the cooling surfaces 24 can comprise filter surfaces for filtering particulate from the gas flow. Such filter surfaces function to cool the gas flow, as well as filter the gas flow.

A preferred vehicle occupant restraint is an air bag which is inflatable to restrain a vehicle occupant in the event of a collision. Other occupant restraints which can be used in the present invention are inflatable seat belts and seat belt pretensioners.

The present invention is not limited to a vehicle occupant restraint assembly of any particular configuration. One configuration suitable for use with the gas generating composition of the present invention is disclosed in U.S. Pat. No. 4,902,036 to Zander et al. The assembly disclosed in this patent comprises means for positioning an air bag between an occupant of a vehicle and an interior portion of the vehicle, to protect the occupant from an impact with the interior portion of the vehicle, in the event of a collision involving the vehicle. The assembly can be installed in the steering wheel of the vehicle. A gas generator, including a housing, produces a sufficient quantity of gaseous combustion products to inflate the air bag. The housing has an igniter which is positioned axially within the housing. A gas generating composition is arranged in a doughnut-shaped configuration around the igniter. Upon ignition of the igniter, reaction products from the igniter ignite the gas generating composition.

The igniter 18 of the present invention can be the same as the igniter shown in the Zander et al. U.S. Pat. No. 4,902,036. This igniter comprises a squib containing a small charge of an ignitable combustible material. Electric leads convey a current to the squib. The current generates heat which ignites the small charge of ignitable material. The current is provided when the sensor responsive to an event such as a vehicle collision closes an electrical circuit that includes a power source. The igniter also has a canister containing a rapidly combustible material such as boron potassium nitrate. The rapidly combustible material is ignited by the small charge of ignitable material. Ignition of the rapidly combustible material provides the threshold energy required to ignite the gas generating composition. Other well known ignition systems capable of producing this threshold energy can also be used.

The gas generating composition 16 within the housing 14 can be in the form of a grain of any desired configuration. The gas generating composition comprises, as the major active ingredients of the composition, lithium azide ($LiN_3$) and a metal oxidant (MeO), wherein O is either oxygen or sulfur. The metal oxidant is present in the gas generating composition in a sub-stoichiometric amount with regard to the lithium azide. Thus, the gas generating composition of the present invention is fuel-rich.

A preferred metal oxidant (MeO) is iron oxide ($Fe_2O_3$). However, the metal oxidant can be any of a number of other oxides or sulfides used for the combustion of alkali metal azides.

Preferred are the transition metal oxides, boron oxide ($B_2O_3$), aluminum oxide ($Al_2O_3$), silicon oxide ($SiO_2$), and sulfur counterparts of these oxides. Examples of suitable transition metal oxides are ferrous oxide ($Fe_3O_4$), copper oxide (CuO), titanium dioxide ($TiO_2$), nickel oxide (NiO) zinc oxide (ZnO), manganese oxide ($MnO_2$) vanadium pentoxide ($V_2O_5$), molybdenum trioxide ($MoO_3$), zirconium oxide ($ZrO_2$), tungsten trioxide ($WO_3$), and the sulfur counterparts of these oxides. Mixtures of metal oxides and sulfides can also be used.

The lithium azide is an energetic material. On ignition, the lithium azide reacts with the metal oxidant, when in a fuel rich ratio, to produce nitrogen, lithium oxide, lithium nitride ($Li_3N$), and elemental metal (of the metal oxidant) in accordance with the following equation:

$$zLiN_3 + Me_xO_y \rightarrow \frac{3z-1}{2} N_2 + yLi_2O + \frac{z-2y}{3} Li_3N + xMe$$

wherein O is either oxygen or sulfur.

Preferably, z equals approximately 3 plus 2y.

The following Table 1 gives representative reactions that take place with representative metal oxides and lithium azide according to the present invention.

Table 1 Sub-Stoichiometric $$9LiN_3+Fe_2O_3 \rightarrow 13N_2+3Li_2O+Li_3N+2Fe$$

$$7LiN_3+TiO_2 \rightarrow 10N_2+2Li_2O+Li_3N+Ti$$

$$5LiN_3+CuO \rightarrow 7N_2+Li_2O+Li_3N+Cu$$

The following Table 2 gives comparative reactions that occur with the use of stoichiometric amounts of a metal oxide and lithium azide:

Table 2 stoichiometric $$6LiN_3+Fe_2O_3 \rightarrow 3Li_2O+2Fe+9N_2$$

$$4LiN_3+TiO_2 \rightarrow 2Li_2O+Ti+6N_2$$

$$2LiN_3+CuO \rightarrow Li_2O+Cu+3N_2$$

It can be seen comparing Tables 1 and 2 that with essentially the same amounts of gas generating material, substantially greater amounts of nitrogen are produced when the ratio of metal oxide to azide is sub-stoichiometric. For instance, with iron oxide, the comparison is 13 mols of nitrogen, in Table 1, compared to 9 mols in Table 2. With titanium dioxide, the comparison is 10 mols against 6, and with copper oxide, the comparison is 7 mols against 3.

In a gas generator apparatus, the weight and volume of the apparatus is almost proportional to the weight and volume of the gas generating composition which is used. Generating more gas per volume of gas generating composition permits a reduction in the amount of the gas generating composition required. Reducing the amount of gas generating composition, in turn, substantially reduces the weight and volume of the gas generating apparatus itself.

In the above reactions of Table 1, it should be noted that only some of the mols of lithium in the gas generating composition are oxidized. In the reaction with iron oxide, in Table 1, one mol of nitrogen combines with three mols of lithium to produce lithium nitride. This reaction is necessary to prevent the formation of lithium metal from the combustion reaction.

To obtain lithium nitride as a reaction product, the amount of cooling surface 24 provided in the vehicle occupant restraint assembly 12 of the present invention is preferably sufficient to cool the flame temperature of the reactants to below the melting point of lithium nitride, preferably to less than about 850° C.

Figure 2:
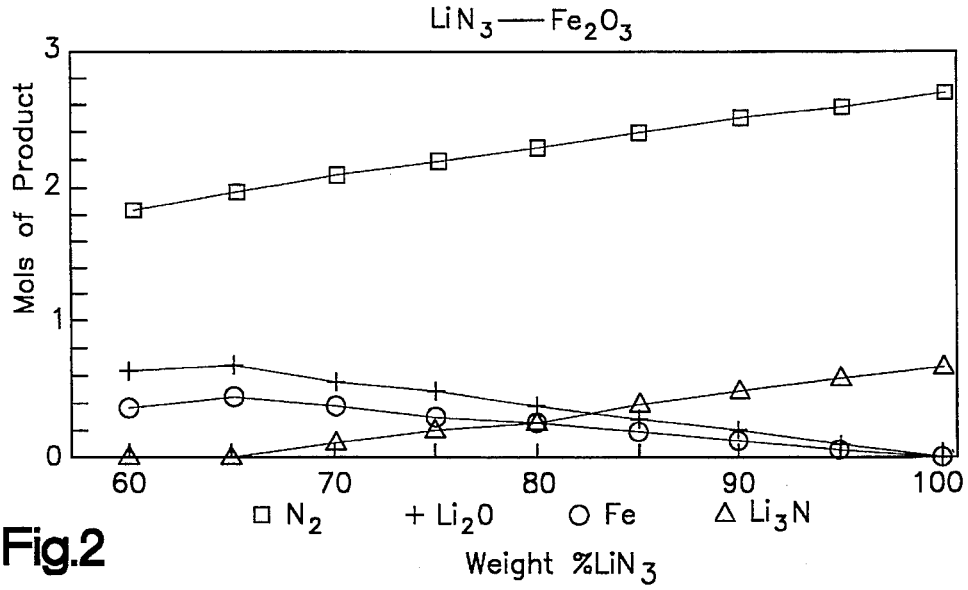
FIG. 2 is a graph plotting mols of reaction products formed from the combustion of a gas generating composition containing lithium azide and iron oxide ($Fe_2O_3$) against weight percent lithium azide in the composition.

The weight ratio of the metal oxidant to lithium azide in the gas generating compositions of the present invention can be any ratio effective to produce lithium nitride as one of the reaction products, or to avoid the formation of elemental lithium. FIG. 2 is a graph plotting mols of reaction products produced against weight percents of lithium azide in a gas generating composition consisting essentially of lithium azide and iron oxide. The data of FIG. 2 is calculated data. At 65 weight percent lithium azide, the mol ratio is stoichiometric. The square data points represent mols of nitrogen produced. It can be seen from FIG. 2 that any increase in weight percent lithium azide above about 60%, increases the amount of nitrogen gas produced, and thus meets this objective of the present invention, namely greater nitrogen production. However, FIG. 2 also shows using the triangle data points, the mols of lithium nitride ($Li_3N$) produced. As can be seen, this reaction product is not formed until the weight percent is above about 65% (above 6.5:1 tool ratio).

Figure 3:
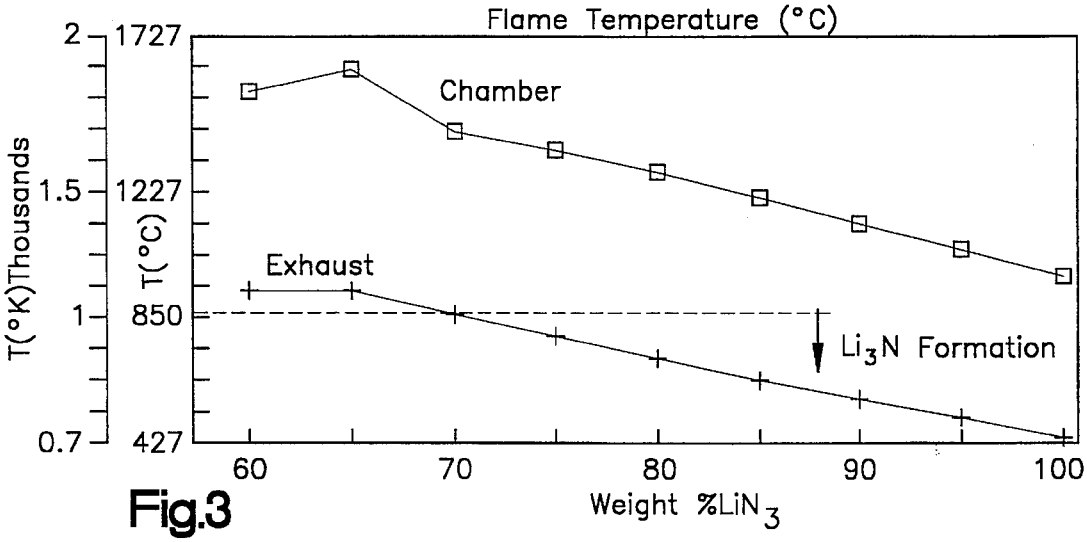
FIG. 3 is a graph plotting chamber and exhaust flame temperatures from the combustion of the gas generating compositions of FIG. 2 against weight percent lithium azide in the composition.

Referring to FIG. 3, which plots the weight percent of lithium azide in the gas generating compositions of FIG. 1 against temperatures, it will be seen that a preferred weight percent is at least about 70% (at least about 7:1 mol ratio). FIG. 3 has two curves, a chamber temperature curve and an exhaust temperature curve. The data for both curves is calculated data. The data for the chamber temperature curve was calculated for a chamber pressure of 1000 psi; the data for the exhaust temperature curve, for an exhaust pressure of one atmosphere. FIG. 3 also has a horizontal line at about 850° C. which represents the melting point of lithium nitride. FIG. 3 shows that as the weight percent of lithium azide is increased, above about 65 weight percent, the flame temperature decreases. However, even the exhaust temperature remains above the melting point temperature for lithium azide up to about 70 weight percent azide. As indicated above, it is desirable to cool the products of combustion to a temperature below the melting point of lithium nitride to promote the formation of lithium nitride.

Although the data of FIGS. 2 and 3 is for compositions containing iron oxide, the same relationships of reactants and products of combustion exist where other metal oxidants are used. Based on this and the data of FIGS. 2 and 3, it has been determined that the metal oxide should be sub-stoichiometric by an amount of at least about 15 mol percent; that is, there should be at least about 15 mol percent excess azide, preferably, about 20 to about 75 mol percent excess azide. The excess mol percent can be calculated as:

$$\frac{\text{mols azide in composition} - \text{stoichiometric mols of azide}}{\text{stoichiometric mols of azide}}$$

When the metal oxide is iron oxide ($Fe_2O_3$), preferably about 20–50 excess mol percent lithium azide is used in the gas generating composition.

From the above description of the invention, those skilled in the art will perceive improvements, changes and modifications. Such improvements, changes and modifications within the skill of the art are intended to be covered by the appended claims.

Having described the invention, the following is claimed:

1. A vehicle occupant restraint assembly comprising:

a vehicle occupant restraint;

a housing;

a gas generating composition within the housing;

an igniter for igniting the gas generating composition; and gas flow means for directing gas from said housing to said vehicle occupant restraint;

said gas generating composition comprising lithium azide and a metal oxidant (MeO) wherein the metal oxidant is present in a sub-stoichiometric amount with respect to the lithium azide, the ratio of lithium azide to metal oxidant being a ratio effective to produce lithium nitride ($Li_3N$).

2. The restraint assembly of claim 1 wherein the gas generating composition burns according to the following equation:

$$zLiN_3 + Me_xO_y \rightarrow \frac{3z-1}{2} N_2 + yLi_2O + \frac{z-2y}{3} Li_3N + xMe$$

wherein O is either oxygen or sulfur.

3. The restraint assembly of claim 2 wherein z equals approximately 3 plus 2y.

4. The restraint assembly of claim 1 comprising cooling surfaces effective to cool the products of combustion of the gas generating composition to below the melting point of lithium nitride.

5. The restraint assembly of claim 1 comprising cooling surfaces effective to cool the products of combustion of the gas generating composition to below 850° C.

6. The restraint assembly of claim 1 comprising at least about 15 mol percent excess lithium azide.

7. The restraint assembly of claim 1 wherein the metal oxidant is an oxide or sulfide of a transition metal, or boron, aluminum, or silicon, or mixtures thereof.

8. The restraint assembly of claim 1 wherein said metal oxidant is iron oxide ($Fe_2O_3$) present in a sub-stoichiometric amount of about 20–50 mol percent excess lithium azide.

9. The restraint assembly of claim 8 wherein said gas generating composition burns according to the following equation:

$$9LiN_3+Fe_2O_3 \rightarrow 13N_2+3Li_2O+Li_3N+2Fe.$$

10. The restraint assembly of claim 9 having a cooling surface effective to cool the products of combustion of the gas generating composition to less than about 850° C.

11. A vehicle occupant restraint assembly comprising:

a vehicle occupant restraint;

a housing;

a gas generating composition within the housing;

an igniter for igniting the gas generating composition; and gas flow means for directing gas from said housing to said vehicle occupant restraint;

said gas generating composition consisting essentially of lithium azide and iron oxide ($Fe_2O_3$) wherein the lithium azide is present in an effective amount to, in reaction with the iron oxide, produce lithium nitride;

heat exchange means in said gas flow means effective to cool the products of combustion of the gas generating composition to less than about 850° C. to produce lithium nitride solids; and filter means to entrap the solids of lithium nitride and other solids in the combustion products.

12. A gas generating composition for inflating a vehicle occupant restraint comprising active ingredients consisting essentially of lithium azide and a metal oxidant wherein the lithium azide is present in an effective amount to, in reaction with the metal oxidant, produce an amount of lithium nitride ($Li_3N$).

13. The composition of claim 12 wherein said metal oxidant is selected from the group consisting of oxides or sulfides of a transition metal, of boron, of aluminum, of silicon or of mixtures thereof.

14. The composition of claim 12 wherein said metal oxidant is iron oxide ($Fe_2O_3$) present in a sub-stoichiometric amount of about 20–50 mol percent excess lithium azide.

15. A gas generating composition for inflating a vehicle occupant restraint comprising active ingredients consisting essentially of lithium azide and a metal oxidant in proportions which react essentially according to the following equation:

$$zLiN_3 + Me_xO_y \rightarrow \frac{3z-1}{2} N_2 + yLi_2O + \frac{z-2y}{3} Li_3N + xMe$$

wherein O is either oxygen or sulfur.

16. The composition of claim 15 wherein z equals approximately 3 plus 2y.

17. A gas generating composition for inflating a vehicle occupant restraint comprising active ingredients consisting essentially of lithium azide and iron oxide ($Fe_2O_3$) in proportions which react essentially according to the following equation:

$$9LiN_3+Fe_2O_3 \rightarrow 13N_2+3Li_2O+Li_3N+2Fe$$

18. A gas generating composition for inflating a vehicle occupant restraint comprising active ingredients consisting essentially of lithium azide and iron oxide ($Fe_2O_3$) in a mol ratio wherein the composition has at least about 15 mol percent excess lithium azide over a stoichiometric ratio of lithium azide to iron oxide, effective to produce $Li_3N$ reaction product.

19. The composition of claim 18 which burns according to the equation:

$$9LiN_3+Fe_2O_3 \rightarrow 13N_3+3Li_2O+Li_3N+2Fe$$

20. The composition of claim 18 which, on ignition, burns to produce a reaction product which is essentially free of elemental lithium.

* * * * *